United States Patent [19]

Kida

[11] Patent Number: 4,914,484

[45] Date of Patent: Apr. 3, 1990

[54] TONER IMAGE FIXING APPARATUS FOR AN IMAGE FORMING MACHINE

[75] Inventor: Hiroshi Kida, Nara, Japan

[73] Assignee: Sharp Kabushiki Kaisha, Osaka, Japan

[21] Appl. No.: 356,947

[22] Filed: May 25, 1989

[30] Foreign Application Priority Data

May 31, 1988 [JP] Japan ..... 63-135051

[51] Int. Cl.[4] ..... G03G 5/20

[52] U.S. Cl. ..... 355/290; 219/216; 355/285; 432/60

[58] Field of Search ..... 385/282, 285, 289, 290; 219/216; 432/60; 100/179, 158 R

[56] References Cited

U.S. PATENT DOCUMENTS

| | | | |
|---|---|---|---|
| 3,706,491 | 12/1972 | Furman et al. | 355/283 X |
| 4,188,109 | 2/1980 | Idenawa et al. | 355/282 |
| 4,780,742 | 10/1988 | Takahashi et al. | 355/290 |
| 4,812,873 | 3/1989 | Inagaki et al. | 355/290 |
| 4,843,214 | 6/1989 | Higashi et al. | 355/290 X |

FOREIGN PATENT DOCUMENTS 57-3943 1/1982 Japan .

*Primary Examiner*—Arthur T. Grimley
*Assistant Examiner*—Thu Dang
*Attorney, Agent, or Firm*—Birch, Stewart, Kolasch & Birch

[57] ABSTRACT

In a toner image fixing apparatus for an image forming machine, toner image transferred on a paper is heated at a predetermined fixing temperature. The fixing temperature is set to be larger than or equal to the toner melting temperature plus 10 [°C.], and smaller than or equal to the toner melting temperature plus 20 [°C.], in order to prevent rumples from forming on the paper. The paper is run at a predetermined speed slightly lower than the transfer speed of 60 mm/sec or less. Two cylindrical rollers are used to press the paper. The hardness of the surface of one of the rollers is set at 40° or more. The fixing length of the portion where the rollers are in contact with one another is set at 2.5 mm or less. The distance between the fixing apparatus and the edge of a guide plate is set to be larger than or equal to 0.2 times the diameter of one of the rollers. Another aspect of the invention is setting the fixing speed higher than or equal to 1.005 times transfer speed, and lower than or equal to 1.02 times the transfer speed.

4 Claims, 4 Drawing Sheets

TONER IMAGE FIXING APPARATUS FOR AN IMAGE FORMING MACHINE

BACKGROUND OF THE INVENTION

1. Field of the Invention

The present invention relates to a toner image fixing apparatus for an electrostatic transfer type image forming machine such as a copying machine, a printing machine or the like.

2. Description of the Related Art

Conventionally, electrostatic transfer type copying machines have been widely used as one of business machines. In the electrostatic transfer type copying machine, a document is illuminated by a light source, and the light image reflected from the document is focused onto a surface of a cylindrical photoconductive drum by an optical system so as to form the image of the document thereon. When the light image of the document is projected on the surface of the photoconductive drum having, been electrified previously, an electrostatic latent electrostatic latent image is formed thereon corresponding to the light image projected, and thereafter, the electrostatic latent image is developed into a toner image by a developing unit. Then, the toner image is transferred onto a copying paper running at a predetermined transfer speed VP by a transfer unit. The copying paper, onto which the toner image has been transferred, is fed to a fixing unit at a predetermined fixing speed VH in order to fix the toner image thermally, and then, the copying paper is discharged outside of the copying machine.

FIG. 1 is a schematic longitudinal cross sectional view showing a portion of a conventional electrostatic transfer type copying machine 1.

Referring to FIG. 1, after a toner image is transferred onto a copying paper running at the transfer speed VP by the aforementioned transfer unit (not shown), the copying paper is fed to a fixing unit 4 with the aid of a guide member 3. The fixing unit 4 comprises an upper heating roller 5 and a lower heating roller 6. The upper heating roller 5 is constituted by a cylinder made of metal, and is arranged rotatably so that the axial direction thereof is parallel to a horizontal direction. The upper heating roller 5 installs a heating lamp 7 used as a heating source inside thereof, and a coating layer of a resin such as Teflon® resin is formed on the outer surface of the upper heating roller 5. On the other hand, the lower heating roller 6 is made of a material such as silicon rubber, wherein the material of the lower heating roller 6 has a hardness of 30° or less which is prescribed in the Japanese Industrial Standard (referred to as JIS hereinafter) K6301-1975.

In the conventional copying machine 1, the temperatures HT of the surfaces of the upper and lower heating rollers 5 and 6 (referred to as a fixing temperature HT) are set so as to satisfy the following inequality (1):

$$TT+30 \leqq HT \leqq TT+40\ [^\circ C] \quad (1)$$

wherein TT is a melting temperature of the toner to be used as a developer in the copying machine 1. That is, the upper heating roller 5 is heated by the heating lamp 7, and the lower heating roller 6 is pressed on the upper heating roller 5 by a mechanical means (not shown). Therefore, the lower heating roller 6 is heated by the upper heating roller 5, resulting in that the surface temperature of the lower heating roller 6 becomes substantially the same as that of the upper heating roller 5.

Furthermore, the fixing speed VH corresponding to the rotation speeds of the heating rollers 5 and 6 are set so as to satisfy the following inequality (2):

$$0.99\ VP \leqq VH \leqq 1.0\ VP \quad (2)$$

wherein VP is the transfer speed, as described above. If the fixing speed VH at which a copying paper 2 is fed by the fixing unit 4 is larger than the aforementioned transfer speed VP, for example, a tensile force is applied to the copying paper 2 while a toner image is transferred thereonto, and the toner image may not be transferred thereonto properly in the case of a considerably large tensile force.

In the conventional electrostatic transfer type copying machine 1, the distance lH between the edge of the aforementioned guide member 3 on the side of the fixing unit 4 and an intersection at which a virtual line 9 extending in a longitudinal direction of the guide member 3 intersects either of the heating rollers 5 and 6 is set so as to satisfy the following inequality (3):

$$0.1\ DH \leqq lH \leqq 0.15\ DH \quad (3)$$

wherein DH is a diameter of the upper heating roller 5. If the aforementioned transfer speed VP increases, a relatively large force is applied to the copying paper 2, resulting in that rumples are apt to be easily formed on the copying paper 2. In order to suppress the occurrence of the rumples, it is desirable to strongly squeeze the copying paper 2 by the guide member 3. In order to improve the squeezing effect, the end portion 8 of the aforementioned guide member 3 is positioned relatively near to the upper heating roller 5.

Recently, the aforementioned electrostatic transfer type copying machine 1 has been improved considerably in miniaturizing the size and lightening the weight thereof. Generally speaking, it is recognized experientially that the transfer speed VP becomes slower as the size of the copying machine becomes smaller. Thus, when the transfer speed VP becomes slower, the copying paper 2 is heated excessively if the fixing temperature HT is set to satisfy the inequality (1), as in the conventional copying machine 1. Then, snaking patterns are generated on the copying paper 2 discharged on a discharge tray 10 by a cooperative pressing action between the heating rollers 5 and 6, and also rumples are caused on the copying paper 2 if the snaking patterns becomes seriously large.

The fixing temperature HT is set so as to satisfy the inequality (1) because of the following reasons. In the case that the fixing temperature HT is too low, the toner attached to the copying paper 2, transported to the vicinity of the fixing unit 4, is not melted sufficiently, resulting in a portion of the toner which does not melt adhering to the aforementioned heating roller 5, and then, the remaining toner may adhere to the next copying paper 2 to deteriorate the quality of toner image. It is generally referred to as a low temperature offset phenomenon. On the other hand, in the case when the fixing temperature HT is too high, the toner on the copying paper 2 is melted excessively, resulting in that part of the toner melted excessively adheres to the upper heating roller 5. This generally referred to as a high temperature offset phenomenon.

Furthermore, when the transfer speed decreases as described above, the fixing speed VH set so as to satisfy the inequality (2) also decreases, resulting in the copying paper 2 being heated excessively, as described above.

Furthermore, when the aforementioned distance lH is set so as to satisfy the inequality 3), the end portion 8 of the aforementioned guide member 3 is positioned at a position considerably near to the upper heating roller 5. That is, the copying paper 2 is heated by the fixing unit 4 as described above, however, radiant heat is applied to the copying paper 2 positioned in the vicinity of the guide member 3 from the fixing unit 4. Therefore, the heat to be applied to the copying paper 2 is comprised of not only the transfer heat, which is transferred from the heating rollers 5 and 6, but also the aforementioned radiant heat.

In order to prevent such a state, it has been considered to minimize the contact distance LH between the heating rollers 5 and 6 to be as small as possible. Such a technique can be realized by increasing the distance between the center points of the heating rollers 5 and 6. However, since the conventional lower heating roller 6 is made of a relatively soft silicon rubber material, the pressing force between the heating rollers 5 and 6 becomes weak only when the distance between the heating rollers 5 and 6 is increased, such that the fixing process can not be performed properly.

Furthermore, when the aforementioned fixing speed VH decreases, the copying paper 2 is warped before the fixing unit 4, and, as a result, the running path of the copying paper 2 becomes long while heat is applied to the copying paper 2 from the guide member 3 which is heated by the fixing unit 4, resulting in the copying paper 2 being heated excessively, as described above.

Furthermore, in order to prevent the rumples from occurring in the copying paper 2 as described above, the paper 2 should be strongly squeezed by the guide member 3 so as to make the surface of the copying paper 2 smooth. However, the aforementioned squeezing effect can not be expected since the copying paper 2 is warped, as described above.

SUMMARY OF THE INVENTION

An essential object of the present invention is to provide a toner image fixing apparatus for an image forming machine which is capable of transferring and fixing a toner image on a paper in an excellent manner without causing rumples thereon.

According to one aspect of the present invention, there is provided a toner image fixing apparatus for an image forming machine comprising image formation means for forming an electrostatic latent image corresponding to an image of a document on a photoconductive body, development means for developing the electrostatic latent image formed on the photoconductive body as a visible toner image with toner having a predetermined melting temperature, transfer means for transferring the visible toner image formed on the photoconductive body onto a paper running at a transfer speed of 60 mm/sec or less and fixing means for heating the toner image transferred to the paper running at a predetermined fixing speed slightly lower than the transfer speed at a predetermined fixing temperature so as to fix it thereon, the toner image fixing apparatus characterized in that the fixing temperature is set to be larger than or equal to the melting temperature plus 10° C., and smaller than or equal to the melting temperature plus 20° C.

According to another aspect of the present invention, there is provided a toner image fixing apparatus for an image forming machine comprising image formation means for forming an electrostatic latent image corresponding to an image of a document on an photoconductive body, development means for developing the electrostatic latent image formed on the photoconductive body as a visible toner image with toner, transfer means for transferring the visible toner image formed on the photoconductive body onto a paper running at a transfer speed of 60 mm/sec or less and fixing means for heating the toner image transferred to the paper running at a predetermined fixing speed slightly lower than the transfer speed so as to fix it thereon, the fixing means having two cylindrical rollers for pressing the paper therebetween, the toner image fixing apparatus characterized in that the hardness of the surface of one of the rollers is set at 40° or more and the fixing length of the portion where one roller is contact with another roller is set at 2.5 mm or less.

According to a further aspect of the present invention, there is provided a toner image fixing apparatus for an image forming machine comprising image formation means for forming an electrostatic latent image corresponding to an image of a document on an photoconductive body, development means for developing the electrostatic latent image formed on the photoconductive body in a visible toner image with toner, transfer means for transferring the visible toner image formed on the photoconductive body onto a paper running at a predetermined transfer speed and fixing means for heating the toner image transferred to the paper running at a predetermined fixing speed so as to fix it thereon, the toner image fixing apparatus characterized in that the fixing speed is set to be higher than or equal to 1.005 times the transfer speed, and lower than or equal to 1.02 times the transfer speed.

According to still a further aspect of the present invention, there is provided a toner image fixing apparatus for an image forming machine comprising image formation means for forming an electrostatic latent image corresponding to an image of a document on an photoconductive body, development means for developing the electrostatic latent image formed on the photoconductive body in a visible toner image with toner, transfer means for transferring the visible toner image formed on the photoconductive body onto a paper running at a transfer speed of 60 mm/sec or less, fixing means for heating the toner image transferred to the paper running at a predetermined fixing speed slightly lower than the transfer speed so as to fix it thereon, the fixing means having two cylindrical rollers for pressing the paper therebetween, and guide means for guiding the paper on which the visible toner image is transferred by the transfer means to the fixing means, the toner image fixing apparatus characterized in that the distance between the fixing means and the edge of the guide means positioned on the side of the fixing means is set to be larger than or equal to 0.2 times the diameter of one of the rollers.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE PREFERRED EMBODIMENTS

The preferred embodiments according to the present invention will be described hereinafter, referring to the attached drawings.

THE FIRST PREFERRED EMBODIMENT

Figure 2:
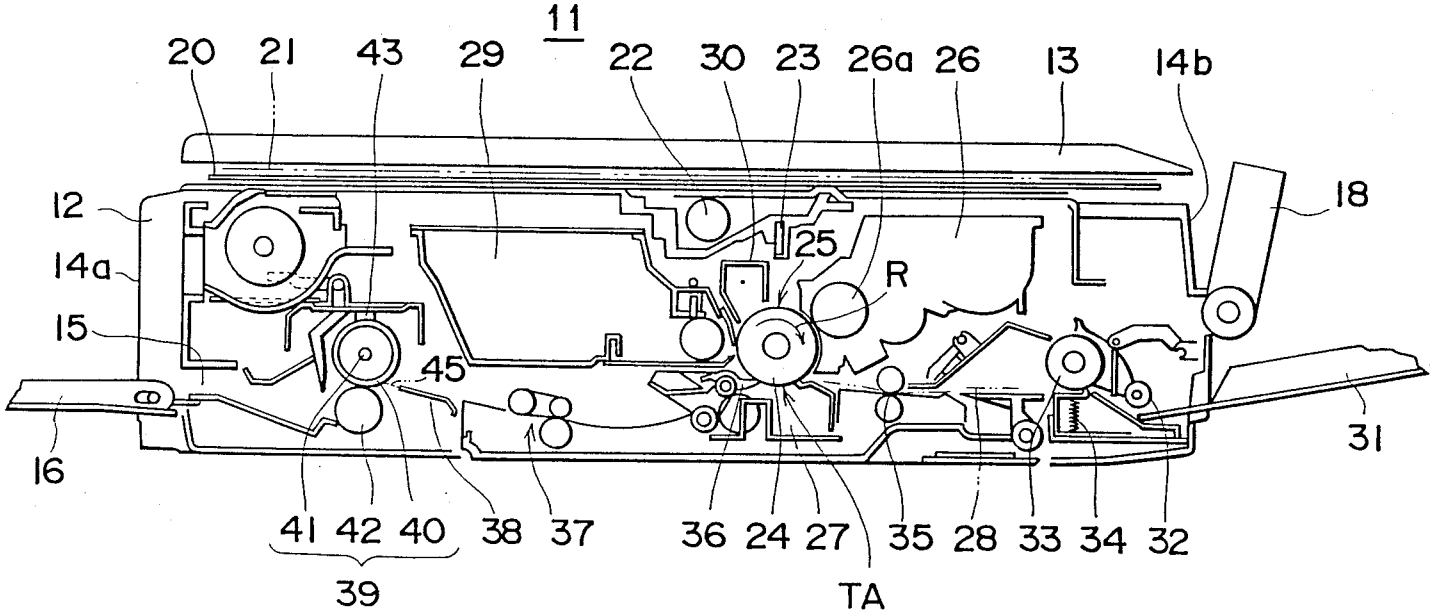
FIG. 2 is a schematic longitudinal cross sectional view showing the whole composition of an electrostatic transfer type copying machine of the preferred embodiment according to the present invention.

FIG. 2 is a schematic longitudinal cross sectional view showing the whole composition of an electrostatic transfer type copying machine 11 of the first preferred embodiment according to the present invention.

Referring to FIG. 2, a document table 20 for arranging a document 21 thereon is arranged movably in a horizontal direction on the upper surface of a body 12 of the copying machine 11, and a document cover 13 for covering and pressing down the document 21 on the document table 20 is arranged on the document table 20. Under the document table 20, there is arranged an exposure optical system comprised of a light source 22 for illuminating the document 21 arranged on the document table 20, and a lens 23 such as a cell fox lens for focusing a light reflected by the document 21 on an exposure area 25 of a surface of a photoconductive drum 24 arranged under the lens 23 so as to form an electrostatic latent image corresponding to the image of the document 21 thereon.

The photoconductive drum 24 is rotated in a direction indicated by an arrow R as shown in FIG. 2 by a driving unit (not shown), in synchronous with the aforementioned movement of the document table 20, i.e., the scan operation for scanning the document 21. Around the photoconductive drum 24 sequentially in the rotation direction thereof indicated by the arrow R, there are arranged a corona charger 30 for electrifying the surface of the photoconductive drum 24, a development unit 26 comprising a magnetic brush **26*a* for supplying a toner to the surface of the photoconductive drum 24 so as to develop the electrostatic latent image in a visible toner image therewith, a transfer charger 27 for electrifying the surface of the photoconductive drum 24 and a copying paper 28 so as to transfer the visible toner image formed on the surface of the photoconductive drum 24 onto the copying paper 28, a separating nail member 36 for separating the copying paper 28 on which the toner image is transferred from the photoconductive drum 24, and a cleaning unit 29 for removing the toner remaining on the surface of the photoconductive drum 24 after the toner image is transferred to the copying paper 28**.

A handle 18 for carrying the body 12 is arranged on a side portion **14*b* of the body 12, and a paper feeding tray 31 for accommodating the copying papers 28 is arranged under the handle 18. A paper drawing roller 32 for drawing the copying papers 28 loaded on the paper feeding tray 31 one by one is arranged above a left end portion of the tray 31. A paper feeding roller 33 and friction plate 34 for reliably feeding only a sheet of copying paper 28 are arranged on the left side of a paper pick up roller 32. A pair of resist rollers 35 for transporting the copying paper 28 to a transfer area TA positioned between the photoconductive drum 24 and the transfer charger 27 are arranged on the left side of the paper feeding roller 33**.

On the left side of the separating nail member 36, there are arranged transportation rollers 37 for transporting the copying paper 28 separated from the photoconductive drum 24 to a guide member 38, and the guide member 38 for guiding the copying paper 28 transported by the transportation rollers 37 to a fixing unit 39 which is arranged on the left side thereof.

The fixing unit 39 for fixing the toner image transferred on the copying paper 28 comprises an upper heating roller 40 and a lower heating roller 42. The upper heating roller 40 is comprised of a metallic cylinder, and is arranged rotatably in a horizontal direction. The upper heating roller 40 comprises a heating lamp 41 used as a heating source inside thereof, and a coating layer of a resin such as Teflon® resin is formed on the outer surface of the upper heating roller 40. On the other hand, the lower heating roller 42 is made of a material such as silicon rubber, wherein the material of the lower heating roller 42 has a hardness of approximately 40° which is prescribed by the aforementioned JIS K6301 - 1975. Furthermore, the temperature of the upper heating roller 40 is measured by a thermistor 43 which is arranged above the roller 40 in a contact state thereto, and the temperature thereof is controlled so as to keep a predetermined room temperature by a control unit (not shown).

A paper discharge opening 15 is formed in an opposite side portion **14*a* to the side portion 14*b* of the body 12, and a paper discharge tray 16 for receiving the copying paper 28 after the toner image is fixed by the fixing unit 39 is arranged detachably from the paper opening 15**.

An operation of the electrostatic transfer type copying machine 11 will be described hereinafter.

The document 21 arranged on the document table 20 is illuminated by a light source 22, and light reflected by the document 21 is transmitted onto the exposure area 25 of the surface of the photoconductive drum 24 through the lens 23 so that the image of the document 21 is formed on the exposure area 25 of the surface of the photoconductive drum 24.

On the other hand, the surface of the photoconductive drum 24 is electrified by the corona charger 30 arranged on the upper stream side of the aforementioned exposure area 25, and the photoconductive drum 24 is rotated in the direction indicated by the arrow R and the light reflected by the document 21 is exposed to the exposure area 25 as described above, so that an electrostatic latent image corresponding to the image of the document 21 is formed thereon. The electrostatic latent image is developed as a visible toner image with a toner supplied by the magnetic brush **26*a* of the development unit 26, and the visible toner image is transferred to the copying paper 28 transported from the paper feeding tray 31 through the paper pick up roller 32, the paper feeding roller 33, and a pair of resist rollers 35. Thereafter, the toner remaining on the surface of the photoconductive drum 24 is removed by the cleaning unit 29**.

The copying paper 28, after the toner image is transferred thereon, is separated from the photoconductive drum 24 by the separating nail member 36, and is transported to the fixing unit 39 through the guide member 38 by the transportation rollers 37. Thereafter, the toner image transferred to the copying paper 28 is fixed by the fixing unit 39, and the copying paper 28 is sent to the paper exhausting tray 16.

Next, the manner for setting the fixing temperature HT which is defined as the surface temperature of the heating roller 5 of the fixing unit 39 will be described hereinafter.

In the present preferred embodiment, the fixing temperature HT is set to be considerably lower than that of the conventional copying machine. Namely, the melting temperature TT of the toner such as 140 ° C. is predetermined according to the kind of the toner to be used, and the fixing temperature HT is set so as to satisfy the following inequality (4):

$$TT+10 \leqq HT \leqq TT+20\ [^\circ C] \quad (4)$$

As described above, a snaking pattern is formed on the copying paper 2 when heated excessively upon fixing the toner image. Therefore, in order to judge the degree of the excessive heating, the difference between the moisture contents of the copying paper before and after the fixing process (referred to as a moisture content difference hereinafter) was measured varying the fixing temperature HT and transfer speed VP. The result of this experiment is shown in Table 1. Furthermore, the moisture content difference was measured in the conventional copying machine having a relatively high transfer speed VP as comparable examples similarly, and the result of this experiment is shown in Table 2. These experiments were performed under the following conditions:

(1) Unitary mass of the copying paper : 62 grms/$m^2$
(2) Initial moisture content of the copying paper : 5 %
(3) Melting temperature TT of the used toner : 140 ° C.
(4) Fixing distance LH of the portion where the heating rollers 40 and 42 are in contact with each other : 3 mm In Table 1, a symbol "O" represents that no rumple is caused on the copying paper upon fixing the toner image, and a symbol "x" represents that rumples are caused. On the other hand, in the case of the conventional copying machine having a high transfer speed as shown in Table 2, it was confirmed that no rumple is caused. According to the result of the experiment shown in Table 2, it was found out that the moisture content difference was approximately 2 %. According to the result of the experiment shown in Table 1, the moisture content difference when no rumple pattern is caused is approximately 2.54 % at the maximum. Therefore, if the copying paper has an initial moisture content of approximately 5 %, it is desirable to control the moisture content difference so as not to exceed approximately 2.5 % in order to prevent rumples from occurring.

On the other hand, the dependency of the moisture content difference upon the fixing temperature HT was confirmed from the results shown in Tables 1 and 2, as follows. Namely, as shown in Table 2, in the case of a transfer speed VP of 70 mm/sec, no rumple is caused on the However, as shown in Table 1, in the case of a transfer speed VP of 60 mm/sec, rumple patterns are caused thereon at a fixing temperature of 170 ° C. Accordingly, in the copying machine 11 having a transfer speed VP of 60 mm/sec or less, the fixing temperature HT is preferably set so as to satisfy the above inequality (4). When the fixing temperature HT is smaller than (TT+10) ° C., the toner image may not be fixed properly because of shortage of melting heat.

When the fixing temperature HT is set as described above, the toner image can be fixed on the copying paper 28 by the fixing unit 39 excellently, and also it is confirmed that the inequality (4) is a proper range in which the toner image is not fixed thereon poorly. Furthermore, it is confirmed that rumple patterns can be prevented from occurring in the copying paper 28.

THE SECOND PREFERRED EMBODIMENT

In the aforementioned first preferred embodiment, the fixing temperature HT is set to be a lower value than that of the conventional example, in order to solve the problems as described in the description of the related art. However, in the present preferred embodiment, the aforementioned fixing distance LH is set to be a smaller value than that of the conventional example. The composition of the copying machine of the present preferred embodiment has an essentially same as that of the aforementioned first preferred embodiment. The aforementioned technical problems are caused by heating the copying paper 28 excessively, and therefore, it is supposed that the above problems can be solved by decreasing the heating amount to be applied from the fixing unit 39 to the copying paper 28. Generally, in this copying machine 11, the aforementioned transfer speed VP is determined first of all. Accordingly, a fixing time HS for which the leading end of the copying paper 28 runs through the fixing distance LH is expressed by the following equation (5):

$$HS = LH / VP \quad (5)$$

According to the above equation (5), it is understood that the fixing time HS can be decreased by decreasing the fixing distance LH in order to solve the aforementioned technical problems.

As described in the aforementioned first preferred embodiment, the aforementioned fixing distance LH has a length such as approximately 3 mm because the upper heating roller 40 bites the lower heating roller 42 made of silicon rubber. Accordingly, the following two methods for decreasing the aforementioned fixing distance LH as much as possible can be considered:

(1) To make the hardness of the surface of the lower heating roller 42 higher.
(2) To make the fixing pressure WH between the upper and lower rollers 40 and 42 lower in place of making the hardness of the surface of the lower heating roller 42 harder.

Figure 4:
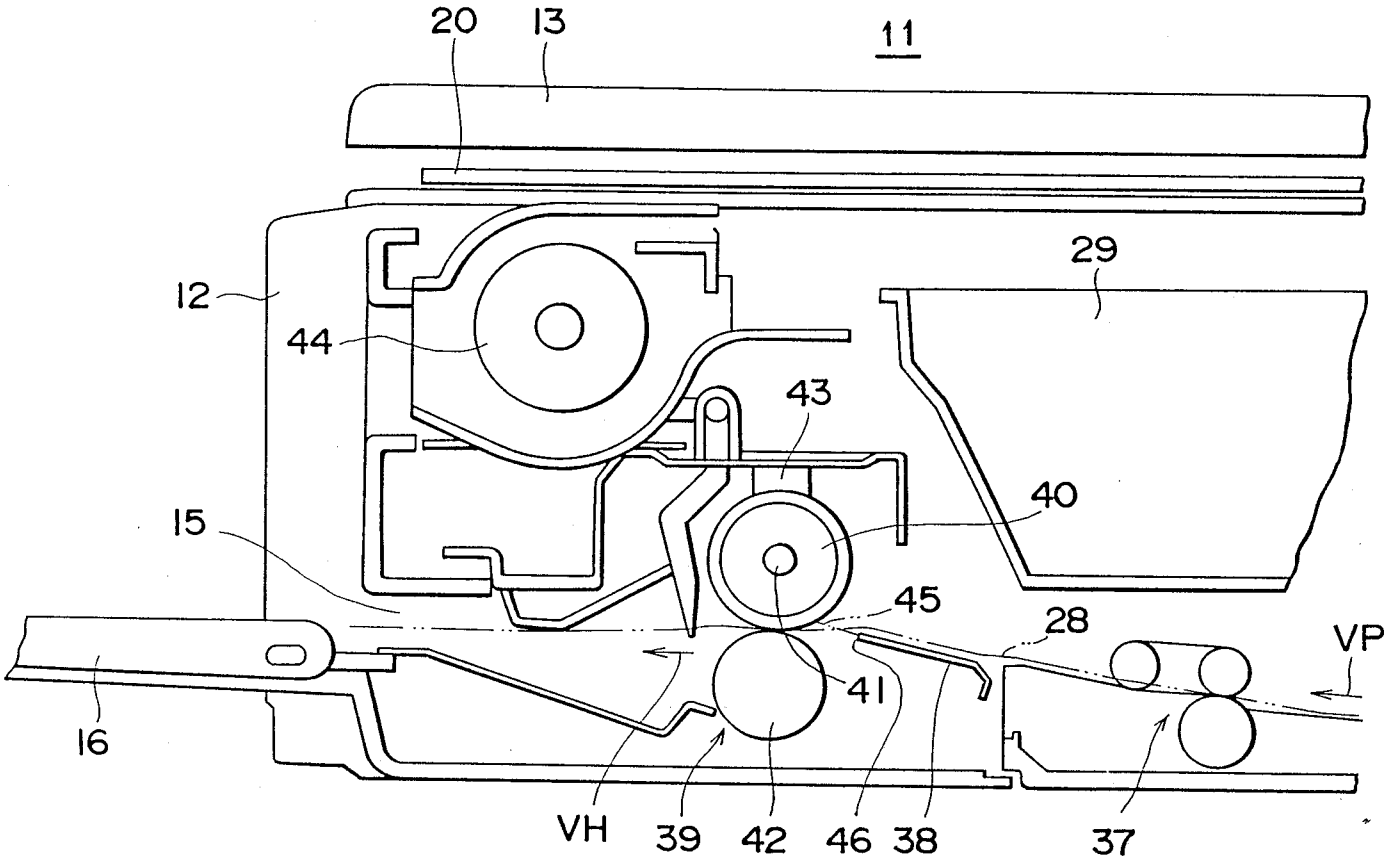

In order to evaluate these methods, the present inventor not only measured the fixing distance LH and the fixing time HS but also checked occurrence of rumple patterns by varying the hardness of the surface of the lower heating roller 42 stepwise. Furthermore, the above measurement and check operation were performed by varying the fixing pressure. The results of above measurement and check operation are shown in Tables 3 and 4. The results of the above measurement and check operation shown in Table 3 were obtained under the condition of a transfer speed VP of 60 mm/sec, a fixing force WH of 8 kgs, and a fixing temperature HT of 170 ° C., and the results of the above measurement and check operation shown in FIG. 4 were obtained under the condition of a transfer speed of 62 mm/sec, a fixing force WH of 2.8 kgs, and a fixing temperature HT of 170 ° C.

In the items of the rumple patterns of Tables 3 and 4, a symbol "O" represents that no rumple pattern is caused in the copying paper 28, and a symbol "x" represents that rumple patterns are caused thereon.

The present inventors confirmed that the fixing time HS becomes 50 msec in a conventional copying machine having a transfer speed VP of 70 mm/sec and a fixing distance LH of 3.5 mm, and assumed that the maximum fixing time HS being capable of preventing any rumple pattern from occurring was 50 msec.

According to the results of the measurement and check operation shown in Tables 3 and 4, rumple patterns is observed on the copying paper 28 in the case of the hardness of 30° although the fixing time HS is shorter than the maximum assumed (HS=43 msec). Further, as shown in Table 4, in spite that the fixing time HS is shorter than 43 msec, rumple patterns are caused.

These results are considered due to the fact that total amount of heat applied to the copying paper 28 is different in the case that the fixing velocity VH has been set at a relatively large value and in the case that the fixing length LH has been set at a relatively small value. Namely, since the fixing time VH calculated from the fixing distance LH is the time interval for which the copying paper 28 is pressed between the upper and lower heating rollers 40 and 42 actually, it reflects only the heat amount transmitted to the copying paper 28 directly from the heating rollers 40 and 42. Practically, even before or after the copying paper 28 is pressed between the heating rollers 40 and 42, the copying paper 28 receives a radiant heat from the heating rollers 40 and 42. These exceptions contrary to the above assumption may be caused due to this fact.

Tables 3 and 4 shows that various results were obtained by varying only the fixing force WH while keeping other conditions unchanged. This is because of the fact that the copying paper 28 is contracted and corrugated easily if the fixing pressure WH to be applied to the copying paper 28 is very small. Therefore, it is considered that rumple patterns may be caused even though the fixing time HS is set to be a relatively small value.

Accordingly, in the copying machine 11 having a relatively slow transfer speed VP of an order of 60 mm/sec or less, in order to transfer the toner image on the copying paper 28 at a proper melting temperature thereof properly and also prevent a rumple pattern from occurring therein, the fixing pressure WH is preferably set to be 3 kgs or more and the lower heating roller 42 is preferably made of a silicon rubber having a hardness thereof 40 ° or more, so that the fixing distance LH is set to be 2.5 mm or less. The copying machine of the present preferred embodiment composed thus has the same effect as that of the aforementioned first preferred embodiment.

THE THIRD PREFERRED EMBODIMENT

Figure 1:
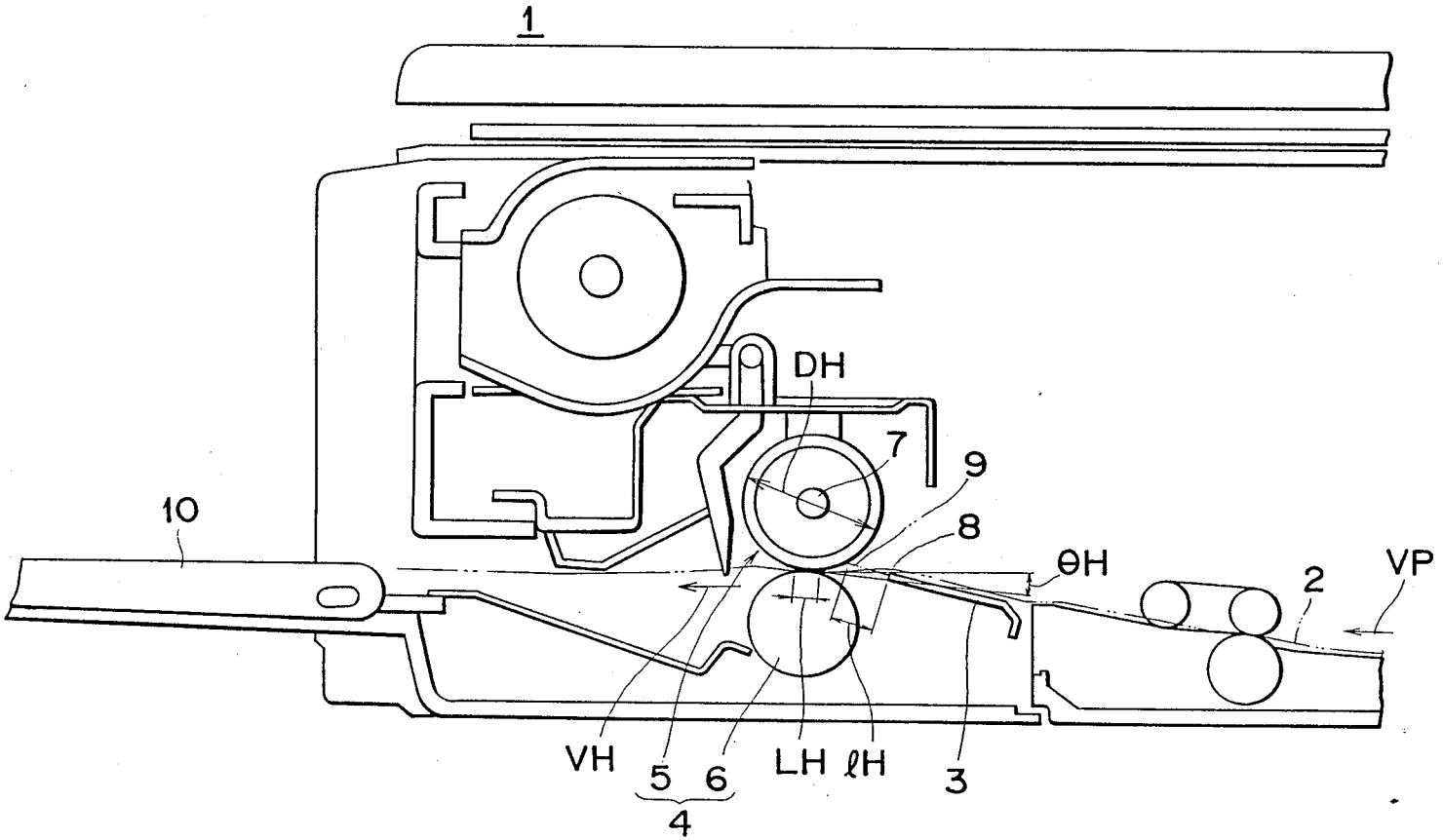
Fig. 1 PRIOR ART
FIG. 1 is a schematic longitudinal cross sectional view showing a portion of a conventional typical electrostatic transfer type copying machine.

In the aforementioned embodiment, when the transfer speed VP and the fixing speed VH are set so as to satisfy the aforementioned inequality (2) and the aforementioned transfer speed VP is set to be 60 mm/sec or less, as shown in FIG. 1 referred in the description of the related art, the copying paper 2 is warped at a position before the fixing unit 4, and then, the copying paper 28 is close to the heating rollers 5 and 6 beyond a predetermined preferable fixing distance LH, and the total heat amount applied to the copying paper 2 due to the direct heat transmission and heat radiation becomes too large.

Furthermore, the reason why the aforementioned rumple pattern is caused by the warp of the copying paper 2 is that the copying paper 2 is not pressed on the guide member 3 properly, and thereby, the aforementioned "squeezing effect" of the guide member 3 is lowered.

In order to solve this problem, in the present preferred embodiment, the fixing speed VH is set so as to satisfy the following inequality (6):

$$1.005\ VP \leqq VH \leqq 1.02\ VP \qquad (6)$$

If the fixing speed VH is set so, the fixing speed VH becomes higher than the transfer speed VP, and the copying paper 28 is tensed between the fixing unit 39 and the vicinity of the transfer charger 27 in the running direction thereof. Accordingly, the aforementioned two problems due to the warp of the copying paper 28 can be solved.

Next, an experiment for determining respective coefficients of the transfer speed VP to be used in the aforementioned inequality (6) for determining the range of the fixing speed VH will be described. In the experiment, occurrence of rumple patterns and mistransfer of toner image were checked while increasing the fixing speed VH relative to the transfer speed VP stepwise. The result is shown in Table 5, wherein IR denotes the rate of increase of VH relative to VP as defined by the following equation (7).

$$IR = \frac{VH - VP}{VH} \times 100\ [\%] \qquad (7)$$

The experiment was done under the conditions of a transfer speed VP of 60 mm/sec, a fixing temperature HT of 170 ° C., and a transfer pressure WH of 8 kgs.

According to Table 5, it is confirmed that the aforementioned increasing rate IR of the fixing speed VH is preferably in the range from 0.5 % to 2.0 % in order to prevent rumple patterns and mistransfer of toner image effectively.

THE FOURTH PREFERRED EMBODIMENT

As described above, in the conventional copying machine, the distance :H which is the length of the virtual line 45 extending from the end portion of the guide member 38 positioned on the side of the fixing unit 39 to the outer surface of the fixing unit 39 is set to be approximately in the range from 0.1DH to 0.15DH, wherein DH is the diameter of the upper heating roller 40. In the conventional copying machine composed thus, there are various technical problems as described above.

In the present preferred embodiment, the aforementioned distance lH is set to be a larger value such as 0.2DH than that of the conventional copying machine. Then, the end portion 46 of the guide member 38 is further than the position of the conventional copying machine from the outer surface of the upper heating roller 40, and therefore, the heat amount to be applied to the copying paper 28 by the heating rollers 40 and 42 is decreased.

Figure 3:
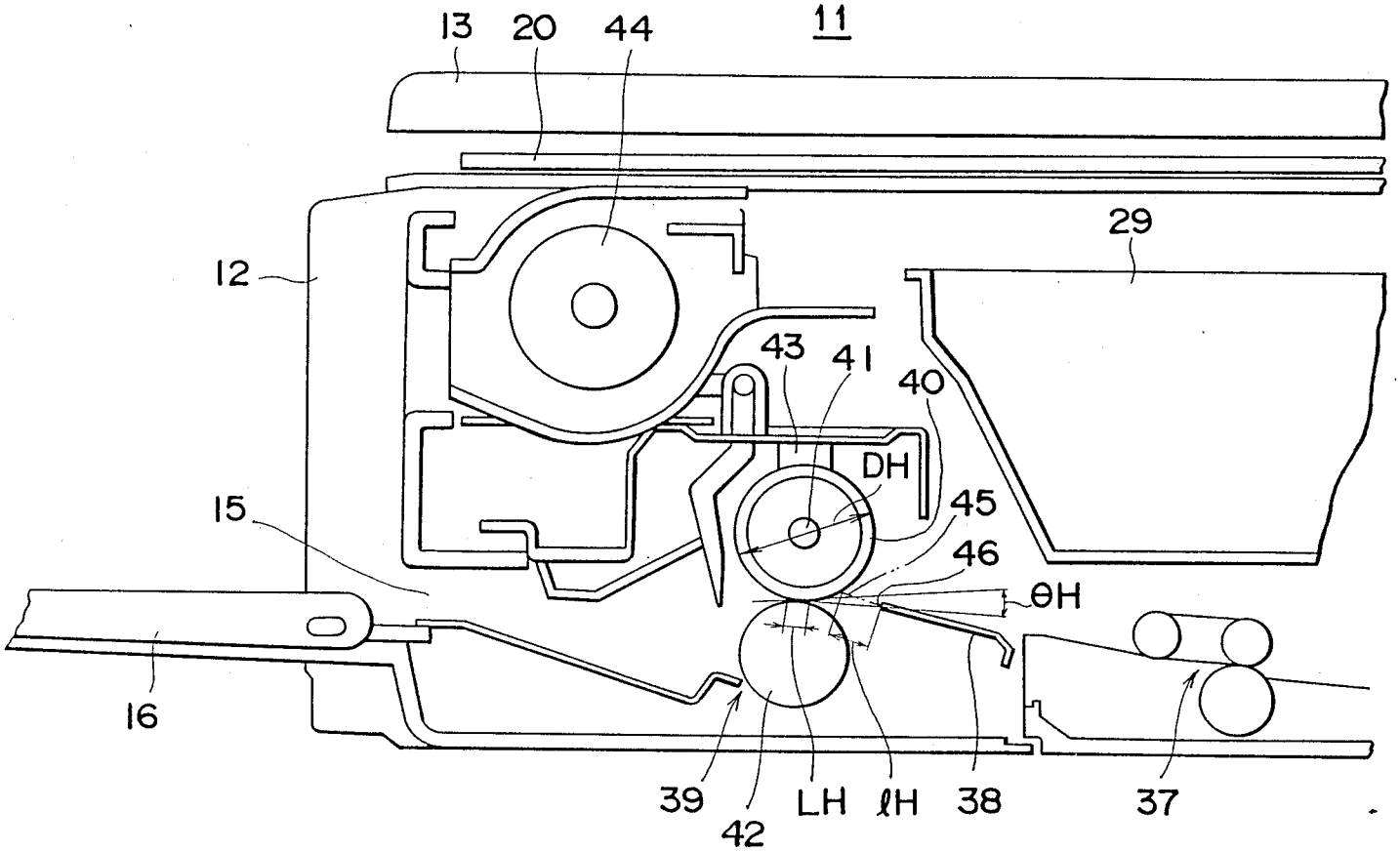
FIGS. 3 and 4 are schematic longitudinal cross sectional views showing a portion of the copying machine shown in FIG. 2, respectively.

The sliding angle θH as defined above is set to be approximately 8°. Namely, the guide member 38 is inclined at a larger angle than that of the conventional copying machine so that the end portion 46 is positioned at an upper position than that of the conventional copying machine, as shown in FIG. 3. Accordingly, even though the end portion 46 of the guide member 38 is further than that of the conventional copying machine from the outer surface of the upper heating roller 40, the guide member 39 has an essentially same squeezing effect on the copying paper 28 as that of the conventional copying machine.

In order to determine the relationship between the aforementioned distance :H and the diameter DH of the upper heating roller 40, occurrence of rumple patterns and/or real rumples formed by folding the copying paper partially was checked while varying the ratio of the distance lH to the distance DH. The result of this experiment is shown in Table 6. The experiment was performed under the condition of a transfer speed VP of 60 mm/sec, a fixing temperature HT of 170 ° C., a sliding angle θH of 8 °, and the diameter DH of the upper heating roller 40 of 25 mm.

According to the result of the experiment shown in Table 6, the distance lH is in the following range in order to prevent rumple patterns and real rumples from forming:

$$0.2DH \leqq lH \leqq 0.4DH \quad (8)$$

However, it is supposed that the above range varies when various sliding angle θH is set. Accordingly, in the copying machine 11 having a transfer speed VP of 60 mm/sec which is used in respective above preferred embodiments, the distance lH is set preferably to be 0.2DH or more. In the copying machine composed thus, an essential same effect can be obtained as that of the aforementioned preferred embodiments.

The present inventor made various copying machines 11 composed as described above, having the parameters of the following range, under the condition of a transfer speed VP of 50 mm/sec, a melting temperature TT of the toner of 140 ° C., the fixing temperature HT of 160 ° C., a fixing pressure WH of 8 kgs, and a diameter DH of the upper heating roller 40 of 25 mm.

(a) The distance lH : 0.22DH
(b) The fixing speed VH : 1.01VP
(c) The sliding angle θH : approximately 8°
(d) The thickness t of the upper heating roller 40 : 0.9
(e) The diameter of the lower heating roller 42 : 18 mm
(f) The thickness t of the lower heating roller 42 : 4 mm
(g) The hardness of the surface of the lower heating roller 42 : 45° to 55°
(h) The fixing distance LH : approximately 2 mm In various copying machines 11 made as described above, the present inventor confirmed that various kind of aforementioned effects could be obtained.

THE OTHER MODIFICATIONS

In respective aforementioned preferred embodiments, the copying machines having an independent composition are described, respectively. However, the copying machine having a proper combination of parameters set in respective aforementioned preferred embodiments may be used.

It is understood that various other modifications will be apparent to and can be readily made by those skilled in the art without departing from the scope and spirit of the present invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which the present invention pertains.

TABLE 1

| Fixing Temperature HT [°C.] | Transfer Speed VP [mm/sec] 50 | | 55 | | 60 | |
|---|---|---|---|---|---|---|
| 150 | 2.32% | O | 2.28% | O | 2.20% | O |
| 160 | 2.54% | O | 2.48% | O | 2.44% | O |
| 170 | 2.68% | X | 2.66% | X | 2.66% | X |

TABLE 2

| Fixing Temperature HT [°C.] | Transfer Speed VP [mm/sec] 70 | 110 | 260 | 350 |
|---|---|---|---|---|
| 180 | 2.22% | 1.90% | 1.94% | 2.14% |

TABLE 3

| Hardness [°] | 25 | 30 | 40 | 50 | 60 | 70 | 80 |
|---|---|---|---|---|---|---|---|
| Fixing Distance LH[mm] | 3.0 | 2.6 | 2.1 | 2.0 | 1.8 | 1.5 | 1.3 |
| Fixing Time HS[mm/sec] | 50 | 43 | 35 | 33 | 30 | 25 | 22 |
| Rumple Patterns | X | X | O | O | O | O | O |

TABLE 4

| Hardness [°] | 25 | 30 | 40 | 60 |
|---|---|---|---|---|
| Fixing Distance LH[mm] | 1.5 | 1.3 | 1.0 | 0.8 |
| Rumple Patterns | X | X | X | X |

TABLE 5

| Increasing Rate IR of Fixing Speed VH [%] | 0 | 0.5 | 1.0 | 1.5 | 2.0 | 2.5 | 3.0 |
|---|---|---|---|---|---|---|---|
| Rumple Patterns | X | Δ | O | O | O | O | O |
| Mistransfer of Toner Image | O | O | O | O | Δ | X | X |

TABLE 6

| Distance lH | 0.1DM | 0.15DM | 0.2DM | 0.3DM | 0.4DM |
|---|---|---|---|---|---|
| Rumple Patterns | X | X | O | O | O |
| Rumples | O | O | O | O | Δ |

What is claimed is:

1. A toner image fixing apparatus for an image forming machine comprising:

image formation means for forming an electrostatic latent image corresponding to an image of a document on an photoconductive body;

development means for developing the electrostatic latent image formed on said photoconductive body in a visible toner image with toner having a predetermined melting temperature;

transfer means for transferring the visible toner image formed on said photoconductive body onto a paper running at a transfer speed of 60 mm/sec or less; and fixing means for heating the toner image transferred on the paper running at a predetermined fixing speed slightly lower than the transfer speed at a predetermined fixing temperature so as to fix it thereon;

said toner image fixing apparatus characterized in that the fixing temperature is set to be larger than or equal to the melting temperature plus 10, and smaller than or equal to the melting temperature plus 20.

2. A toner image fixing apparatus for an image forming machine comprising:

image formation means for forming an electrostatic latent image corresponding to an image of a document on an photoconductive body;

development means for developing the electrostatic latent image formed on said photoconductive body in a visible toner image with toner;

transfer means for transferring the visible toner image formed on said photoconductive body onto a paper running at a transfer speed of 60 mm/sec or less; and fixing means for heating the toner image transferred on the paper running at a predetermined fixing speed slightly lower than the transfer speed so as to fix it thereon, said fixing means having two cylindrical rollers for pressing the paper therebetween;

said tone image fixing apparatus characterized in that the hardness of the surface of one of said rollers is set at 40° or more; and the fixing length of the portion where one roller is contact with another roller is set at 2.5 mm or less.

3. A toner image fixing apparatus for an image forming machine comprising:

image formation means for forming an electrostatic latent image corresponding to an image of a document on an photoconductive body;

development means for developing the electrostatic latent image formed on said photoconductive body in a visible toner image with toner;

transfer means for transferring the visible toner image formed on said photoconductive body onto a paper running at a predetermined transfer speed; and fixing means for heating the toner image transferred on the paper running at a predetermined fixing speed so as to fix it thereon;

said toner image fixing apparatus characterized in that the fixing speed is set to be higher than or equal to 1.005 times the transfer speed, and lower than or equal to 1.02 times the transfer speed.

4. A toner image fixing apparatus for an image forming machine comprising:

image formation means for forming an electrostatic latent image corresponding to an image of a document on an photoconductive body;

development means for developing the electrostatic latent image formed on said photoconductive body in a visible toner image with toner;

transfer means for transferring the visible toner image formed on said photoconductive body onto a paper running at a transfer speed of 60 mm/sec or less;

fixing means for heating the toner image transferred on the paper running at a predetermined fixing speed slightly lower than the transfer speed so as to fix it thereon, said fixing means having two cylindrical rollers for pressing the paper therebetween; and guide means for guiding the paper on which the visible toner image is transferred by said transfer means to said fixing means;

said toner image fixing apparatus characterized in that the distance between said fixing means and the edge of said guide means positioned on the side of fixing means is set to be larger than or equal to 0.2 times the diameter of one of said rollers.

* * * * *